US005927585A

United States Patent [19]

Moorman et al.

[11] Patent Number: 5,927,585

[45] Date of Patent: Jul. 27, 1999

[54] ELECTRIC MULTIPLE IMPACT FASTENER DRIVING TOOL

[75] Inventors: Charles J. Moorman, Cincinnati; Joseph A. Schaljo, Batavia, both of Ohio

[73] Assignee: Senco Products, Inc., Cincinnati, Ohio

[21] Appl. No.: 08/992,652

[22] Filed: Dec. 17, 1997

[51] Int. Cl.[6] ..... B25C 05/06

[52] U.S. Cl. ..... 227/132; 227/120; 227/8; 227/146; 173/203

[58] Field of Search ..... 227/132, 129, 227/146, 8, 120, 134, 142; 173/203

[56] References Cited

U.S. PATENT DOCUMENTS

| | | | |
|---|---|---|---|
| 3,299,967 | 1/1967 | Cabot | 173/31 |
| 4,215,808 | 8/1980 | Sollberger | 227/132 |
| 4,511,074 | 4/1985 | Kille | 227/120 |
| 4,566,621 | 1/1986 | Becht | 227/120 |
| 4,625,903 | 12/1986 | Becht | 227/147 |
| 4,671,443 | 6/1987 | Becht | 227/120 |
| 4,724,992 | 2/1988 | Ohmori | 227/132 |
| 5,579,975 | 12/1996 | Moorman | 227/119 |

*Primary Examiner*—Scott A. Smith
*Assistant Examiner*—James P. Calve
*Attorney, Agent, or Firm*—Jerrold J. Litzinger

[57] ABSTRACT

An electric powered multiple impact fastener driving tool comprising a handle portion, a main body portion, a guide block, a magazine, and a guide and biasing assembly mounted in the guide block and affixed to the magazine enabling shifting of the magazine within the guide block between an extended fastener starting position and a retracted fastener driven position. The main body portion contains an impact assembly comprising a motor driven cam wheel with a single drop-off, a cam follower roller mounted on a reciprocable hammer, a compression spring surmounting and abutting the hammer, and a fastener driver. For each rotation of the cam wheel, the cam follower roll lifts the hammer, compressing the spring and storing energy therein. At the cam wheel drop-off, the cam follower wheel and hammer drop under the influence of the spring and the hammer impacts the driver which imparts a blow to the fastener. The cam follower wheel does not contact the cam wheel immediately after drop-off. Further cam wheel rotation will result in contact, greatly reducing wear of the parts. This sequence is repeated until the fastener is driven and the tool thereafter shuts off to conserve energy. At least one switch and cooperating actuator are provided to vary the number of blows per driving cycle and to control the depth of drive.

17 Claims, 15 Drawing Sheets

ELECTRIC MULTIPLE IMPACT FASTENER DRIVING TOOL

TECHNICAL FIELD

The invention relates to a multiple blow fastener driving tool, and more particularly to such a tool wherein a driven cam wheel causes a cam follower, hammer, and compression spring assembly to build and store energy until released by the cam wheel, whereupon the energy is imparted to a fastener driver, with the result that as the cam wheel is rotated, the cam follower, hammer, and spring assembly will cause the driver to impart short drive strokes in rapid succession to the fastener being driven.

BACKGROUND ART

Prior art workers have devised many types of fastener driving tools. As used herein and in the claims, the term "fastener" is to be considered in the broadest sense, referring to substantially any fastener capable of being driven into a workpiece. Examples of such fasteners are pins, brads, headed nails, finishing nails, staples, and the like.

Perhaps the most common form of fastener driving tool is a pneumatically actuated tool. Prior art workers have developed a multiplicity of pneumatically actuated fastener driving tools to a very high degree of safety and sophistication.

More recently, there has been considerable interest in electro-mechanical fastener driving tools utilizing a solenoid mechanism or a fly wheel mechanism to drive the fasteners. Electro-mechanical fastener driving tools are of particular interest for use where a source of compressed air is not available.

The fastener driving tools thus far described are of the single blow variety, wherein the fastener is driven home by a single impact of the tool driver. Such tools are well adapted for industrial use, but they tend to be large, bulky and heavy. Therefore, they are not as well suited for home use, light industrial use or the like.

In light of the above, prior art workers, with an eye to light industrial applications and home uses, have also turned their attention to multiple blow fastener driving tools wherein simple rotary motion, obtained from an appropriate prime mover, is converted to linear reciprocating motion of a driver. Such tools have a number of advantages. First of all, they can employ a low power prime mover. As a result of the reduced power that must be dissipated, as compared to single blow tools, the multiple blow tools are characterized by reduced sound levels. Finally, such tools can be of less complex, more compact and lighter weight construction than the usual single blow tool.

Despite these advantages, multiple blow tools, to date, have not been highly successful in the marketplace. Generally, prior art multiple impact tools have fallen into two basic categories. The first encompasses those tools which accomplish translation of rotary motion into reciprocating motion through the use of some form of eccentric or crank shaft. The second category encompasses those multiple impact tools which employ some form of cam profile for translation of rotary motion to reciprocating motion. The tools of the first category, employing an eccentric or crank shaft for motion translation, accomplish the translation in a very smooth manner, but with a low and diminishing velocity.

Those prior art multiple impact tools which translate rotary motion into reciprocating motion through the use of some form of cam profile address the problem of attaining velocity in one of two ways. A first method is to develop a cam profile which maximizes velocity to the point of reversal of the reciprocating motion. However, the motion translation achieved is not very smooth. The other method is to use a form of cam profile to precondition the drive cycle which is performed by some other power source such as a spring. This approach generally requires an abrupt release by the cam of the other power source (i.e. the spring) in order to release the drive power. This produces high wear on the cam surface. The present invention constitutes an improvement of this general type of multiple impact tool eliminating prior art problems therewith.

It is an object of the present invention to provide a system wherein a cam wheel lifts a hammer and compresses a spring, the spring transferring energy to the hammer and thence to a driver with little or no wear imparted to the cam wheel.

It is an object of the present invention to provide a system wherein the direction of the drive energy is in line with the direction of the nail.

It is an object of the present invention to provide a magazine which shifts vertically between and extended position and a retracted position.

It is an object of the present invention to provide a guide and biasing assembly for the magazine to guide its vertical movement while maintaining its proper orientation and for biasing the magazine to its extended position.

It is an object of the present invention to provide a multiple impact tool with means to control the depth of drive.

It is an object of the present invention to provide a battery powered multiple impact tool which conserves energy by automatically turning off the motor when the magazine is in its uppermost position and when the magazine is in its lowermost position, or when a fastener is fully driven.

It is an object of the present invention to provide an electric multiple impact tool wherein the amount of energy consumed during a drive cycle depends upon the hardness of the workpiece and the force applied by the operator.

It is an object of the present invention to provide an electric multiple impact tool wherein the number of cam rotations per drive cycle can be varied.

DISCLOSURE OF THE INVENTION

According to the invention there is provided an electric powered multiple impact fastener driving tool connectable to a source of ordinary current or provided with a battery pack. The tool comprises a handle portion, a main body portion, a guide block, a magazine, and a guide and biasing assembly mounted in the guide block and affixed to the magazine enabling shifting of the magazine within the guide block between an extended fastener starting position and a retracted fastener driven position.

The main body portion contains an impact assembly by which a fastener is driven into the workpiece. The impact assembly comprises an electric motor, a cam wheel driven by the electric motor and having a single drop-off, a cam follower roller mounted on a reciprocable hammer, a compression spring surmounting and abutting the hammer, a fastener driver, and stop elements to limit the travel of the fastener driver. For each rotation of the cam wheel, the cam follower roller lifts the hammer, compressing the spring and storing energy therein. At the cam wheel drop-off, the cam follower wheel and the hammer drop under the influence of the spring. The cam follower wheel does not contact the cam wheel immediately after drop-off. Further cam rotation will result in cam follower contact, greatly reducing wear of the parts. The hammer at the drop-off point impacts the driver which imparts a sharp blow to the fastener being driven. This sequence is repeated, subjecting the fastener to a rapid sequence of sharp blows until the fastener is fully driven and the tool thereafter shuts off to conserve energy. At least one switch and cooperating actuator are provided to vary the number of blows per drive cycle depending upon the hardness of the workpiece, the length of the fastener and the force applied to the tool by the operator. This also enables control of the depth of drive.

DETAILED DESCRIPTION OF THE INVENTION

For purposes of this description, words such as "top", "bottom", "left", "right", "front", "rear", and the like are applied from the perspective of the operator holding the tool in his hand. Furthermore, these words are used in conjunction with the drawings for purposes of clarity. As is well known, tools of this nature can be held in substantially any orientation dictated by the work being done.

Figure 1:
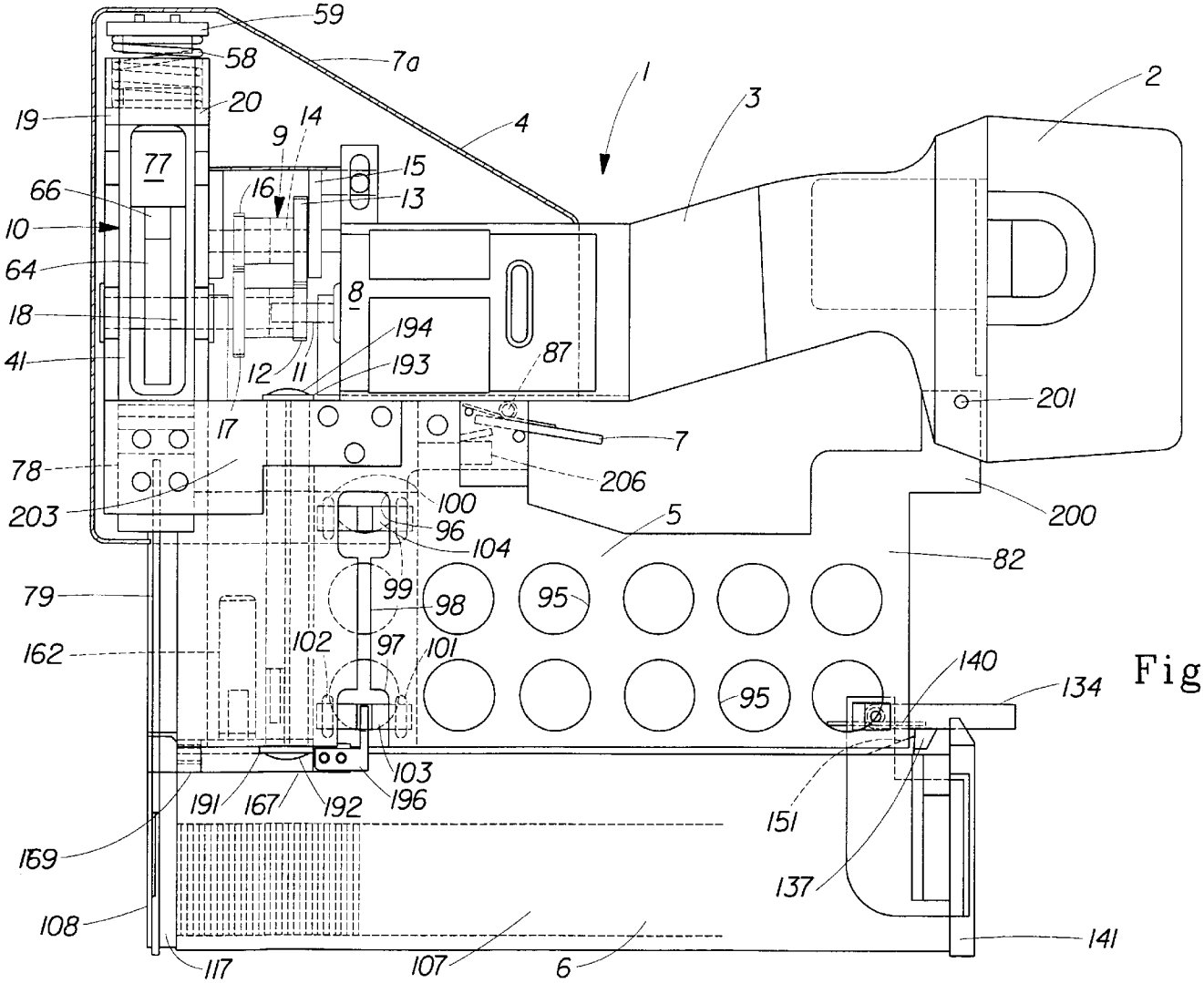
FIG. 1 is a simplified left side elevational view, partly in cross-section, of the multiple impact tool of the present invention, illustrating the magazine in its extended position.
Figure 2:
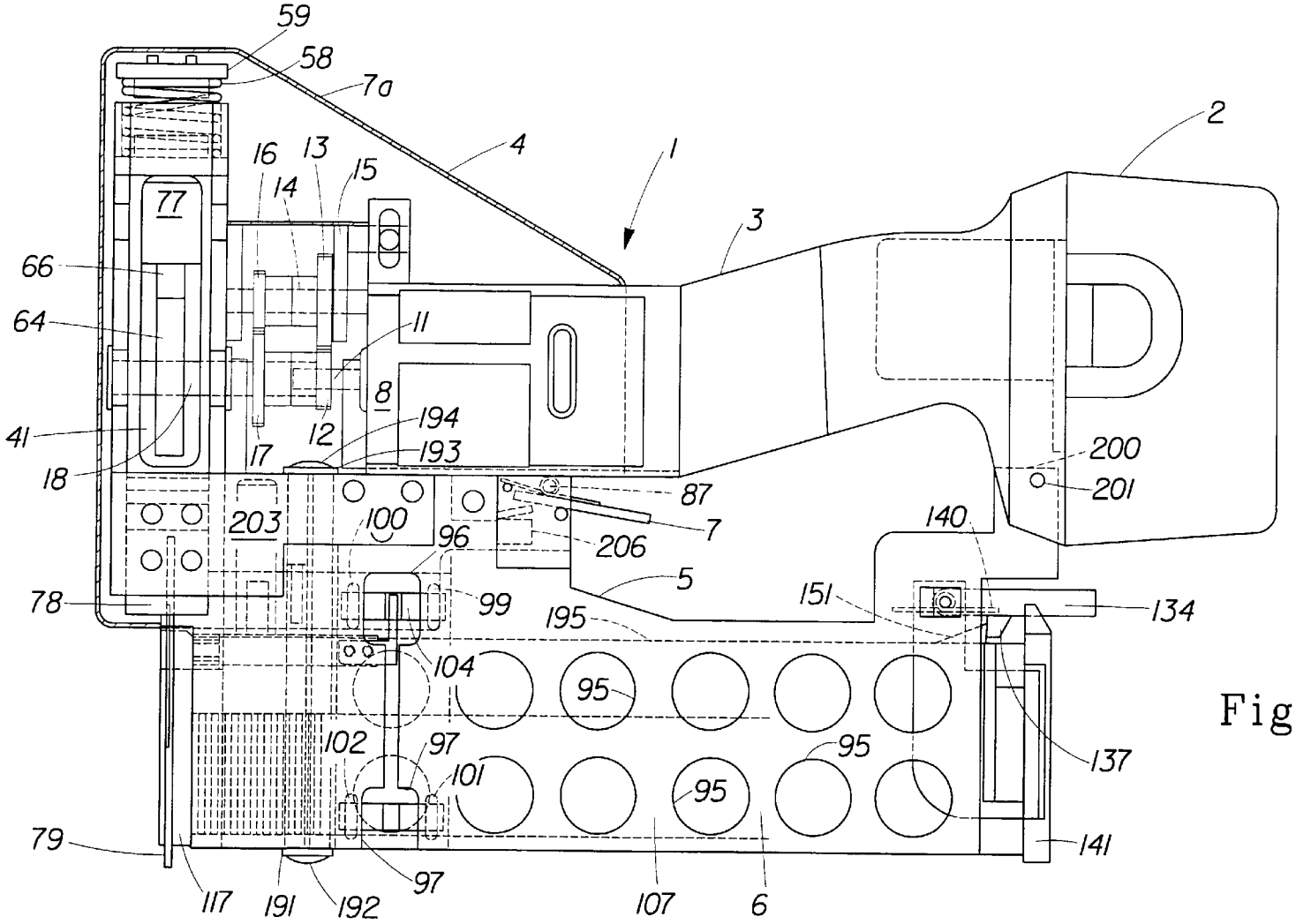
FIG. 2 is a simplified left side elevational view, partly in cross-section, of the tool of the present invention illustrating the magazine in its retracted position.
Figure 3:
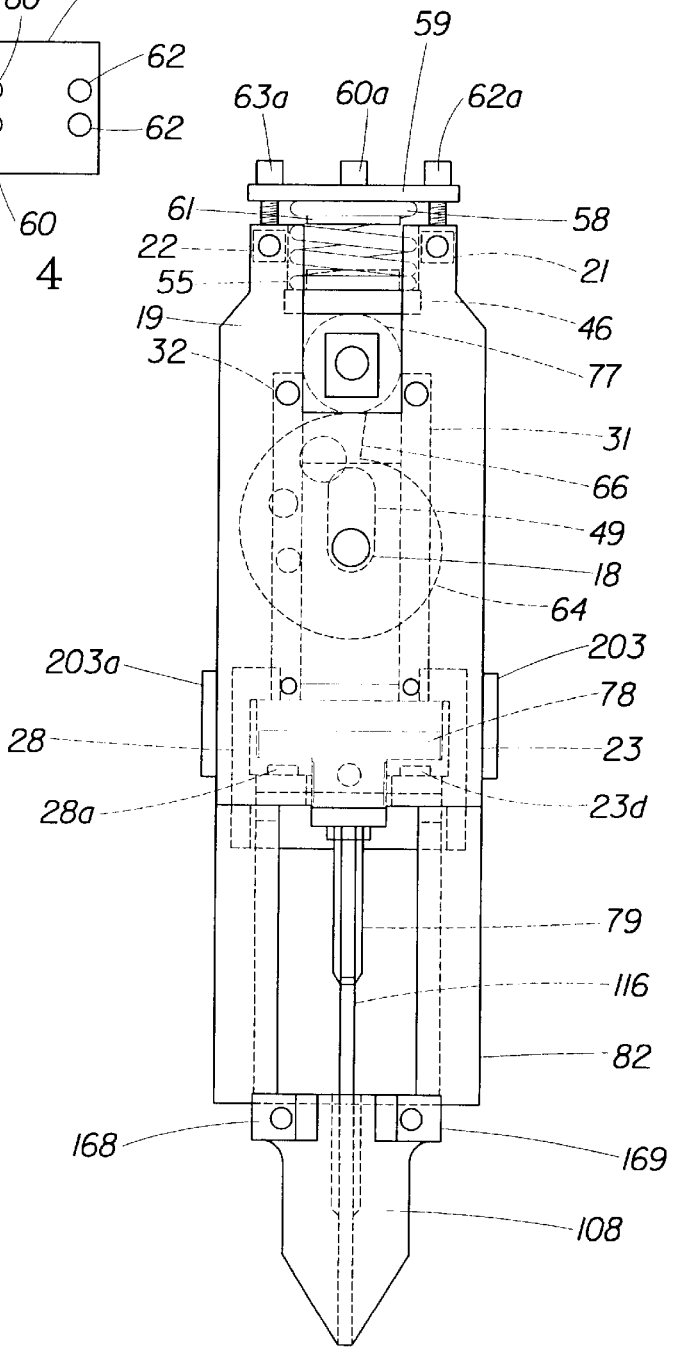
FIG. 3 is a simplified front elevational view of the tool of FIG. 1.

Reference is first made to FIGS. 1, 2 and 3. The tool is generally indicated at 1 and comprises a removable and rechargeable battery pack 2, a handle portion 3, a main body portion 4, a guide block 5, and a shiftable magazine 6. In FIGS. 1 and 3 the magazine is illustrated in its extended position. In FIG. 2 the magazine is shown in its retracted position. Each of the basic parts 2–6 of the tool will be described in detail. The removable and rechargeable battery pack 2 is conventional. It is within the scope of the invention, however, to provide the tool 1 of the present invention with a conventional electric cord and plug for connection to a source of ordinary household current. The handle 3 enables the operator to comfortably grip the tool 1 with his hand so positioned as to provide easy access to the tool trigger 7.

The main body portion 4 is provided with a housing which is shown in cross-section at 7*a*. The housing covers the electric motor 8 of the tool, the gear train generally indicated at 9 and the impact assembly, generally indicated at 10.

Motor 8 has an output shaft 11 on which a first gear 12 is non-rotatively mounted. Gear 12 meshes with gear 13 mounted on jack shaft 14. The jack shaft 14 is provided with an appropriate mount 15. Jack shaft 14 also non-rotatively mounts a third gear 16. The gear 16 is meshed with a gear 17 mounted on the main shaft 18 which supports the cam of the present invention, as will be apparent hereinafter. The gears 12, 13, 16 and 17 provide a reduction of about 4/1 from the motor 8 to the main shaft 18.

Figure 6:
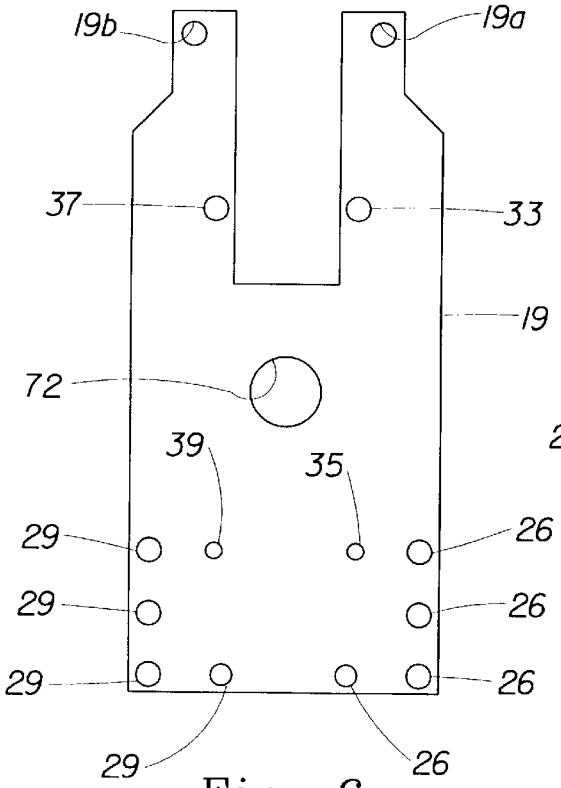
FIG. 6 is a front elevational view of the front frame.
Figure 7:
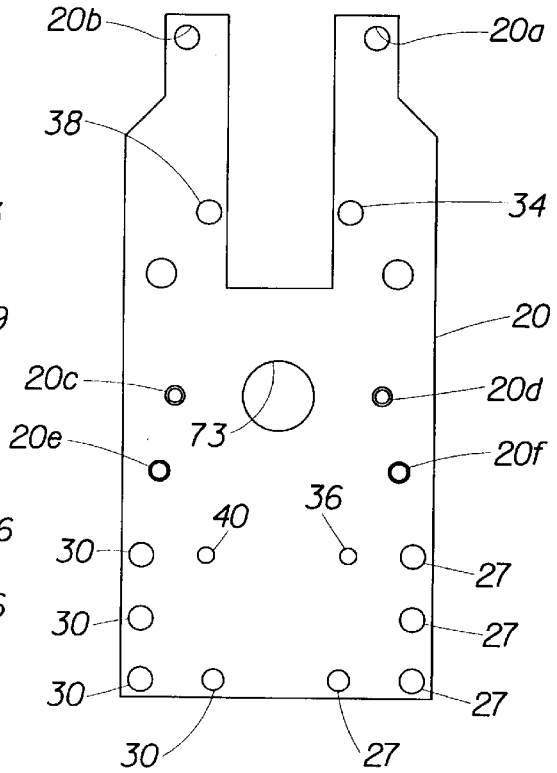
FIG. 7 is a front elevational view of the rear frame.
Figure 8:
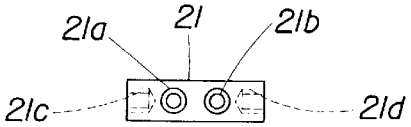
FIG. 8 is a plan view of a spacer bar.

The impact assembly 10 is made up of a front frame 19 and a rear frame 20, illustrated in FIGS. 6 and 7, respectively. FIGS. 6 and 7 show the front surface of each of the frame members 19 and 20. It will be noted that they are identical except for the fact that the rear frame has some additional perforations therethrough, as will be set forth hereinafter. The upper ends of the front frame 19 and the rear frame 20 are held in parallel spaced relationship by a pair of identical spacer bars, one of which is shown at 21 in FIG. 8. Spacer bar 21 is of rectangular cross-section. FIG. 8 is a plan view thereof. It will be noted that spacer bar 21 has a pair of threaded bores 21*a* and 21*b* which extend from the top of the spacer bar through the bottom thereof. The spacer bar also has a pair of threaded bores 21*c* and 21*d*. The bores 21*c* and 21*d* extend axially of the bar inwardly from each end.

As is clearly shown in FIG. 3, spacer bar 21 extends between perforation 19*a* of front frame 19 and perforation 20*a* of the rear frame 20. In the same manner, a second identical spacer bar 22 is attached by screws through front frame perforation 19*b* and rear frame perforation 20*b*.

Figure 12:
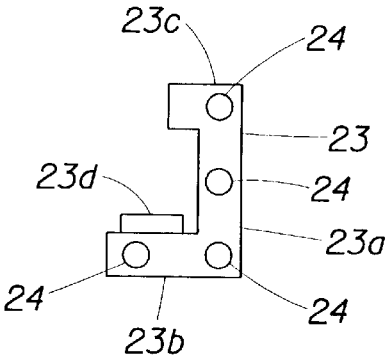
FIG. 12 is a front elevational view of the left stop of the present invention.
Figure 13:
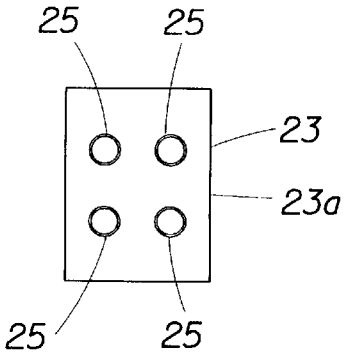
FIG. 13 is a side elevational view of the stop as seen from the right of FIG. 12.

At their lower ends, front and rear frames 19 and 20 are joined together by a pair of oppositely directed stops. The stops may be identical and one such stop is shown at 23 in FIGS. 12 and 13. Stop 23 is somewhat C-shaped, having a vertical portion 23*a*, a lower horizontal portion 23*b* and an upper horizontal portion 23*c*. The upper or inside surface of lower portion 23*b* supports a resilient seat 23*d* such as a neoprene pad. As is clearly shown in FIG. 12, the end elevation of stop 23 is provided with four bores 24. FIG. 13 is an elevational view of the stop 23 of FIG. 12, as seen from the right. It will be noted that the stop 12 also includes four threaded bores 25, the purpose of which will be apparent hereinafter.

It will be noted that the front frame 19 (FIG. 6) has an L-shaped array of bores 26 identical to bores 24 of stop 23. Similarly, the rear frame 20 (FIG. 7) has an L-shaped array of bores 27 corresponding to the bores 24 of stop 23. Four machine screws (not shown) pass through front frame bores 26, stop bores 24, and rear frame bores 27. Each of the machine screws is provided with an appropriate nut. As will be clearly noted in FIG. 3, a second stop 28 is provided which is identical to stop 23. The stop 28 is oppositely directed and is also attached to front frame 19 and rear frame 20 by machine screws which pass through bores 29 in front frame 19, perforations in stop 28 (not shown) which are identical to the perforations 24 in stop 23, and through perforations 30 in rear frame 20. Again, the machine screws are provided with appropriate nuts. It will be immediately evident that the stops 23 and 28 serve as spacers for the bottom ends of front frame 19 and rear frame 20. Stops 23 and 28 have an additional important purpose, which will be pointed out hereinafter. It will be noted from FIG. 3 that stop 28 is also provided with a resilient seat 28*a*, identical to resilient seat 23*d* of stop 23.

It will be apparent from the above that the front frame 19, the rear frame 20, the spacer bars 21 and 22 and the stops 23 and 28 form a rigid frame within which the rest of the elements of the impact assembly 10 are located. A pair of elongated bronze guide bushings are located on the rear surface of front frame 6. These guide bushings are shown in broken lines in FIG. 3 at 31 and 32. It will be understood that the front surface of rear frame 20 will be provided with an identical pair of bronze guide bushings (not shown). Bushing 31 and the corresponding bushing of rear frame 20 are attached by a first machine screw (not shown) passing through perforation 33 in front frame 19, a corresponding perforation in the upper end of guide bushing 31, a cylindrical spacer of appropriate length (not shown), a bore at the upper end of the corresponding bronze bushing adjacent rear frame 20, and through bore 34 in rear frame 20. The machine screw is provided with an appropriate nut. In similar fashion, the lower end of side bushing 31 adjacent front frame 19 and the lower end of the corresponding bushing adjacent rear frame 20 are attached by means of a machine screw which passes through bore 35 of front frame 19, a perforation near the bottom end of guide bushing 31, a cylindrical spacer of appropriate length (not shown), a perforation near the bottom of the corresponding bronze bushing adjacent rear frame 20, and the perforation 36 in rear frame 20. Again, the machine screw is provided with an appropriate nut.

The guide bushing 32 adjacent front frame 19 and its counterpart (not shown) adjacent rear frame 20 are attached in an identical manner. Thus, front frame bore 37 and rear frame bore 38 serve the same purpose as front frame bore 33 and rear frame bore 34. Also, front frame bore 39 and rear frame bore 40 serve the same purpose as front frame bore 35 and rear frame bore 36. These bushings serve as a guide for the vertically movable hammer next to be described. Additional perforations in rear frame 20, i.e. perforations 20*c* through 20*f*, enable an extended portion of the mount for motor 8 to be affixed to the rear frame 20.

Figure 11:
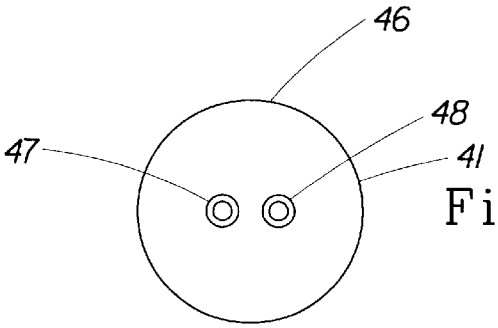
FIG. 11 is a top view of the hammer.
Figure 9:
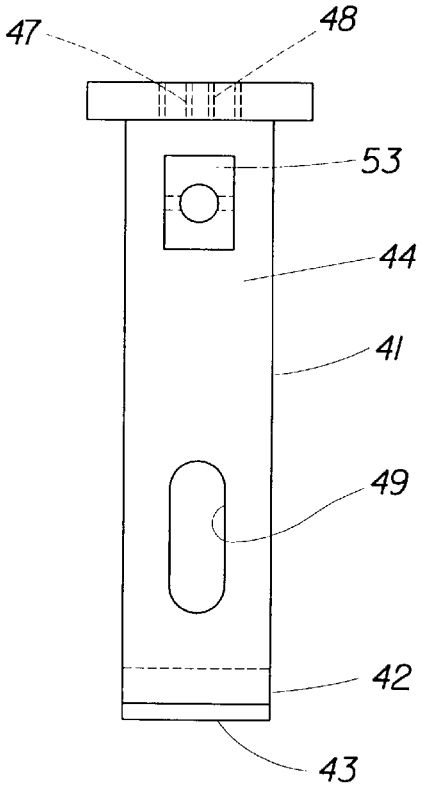
FIG. 9 is a front elevational view of the hammer.
Figure 10:
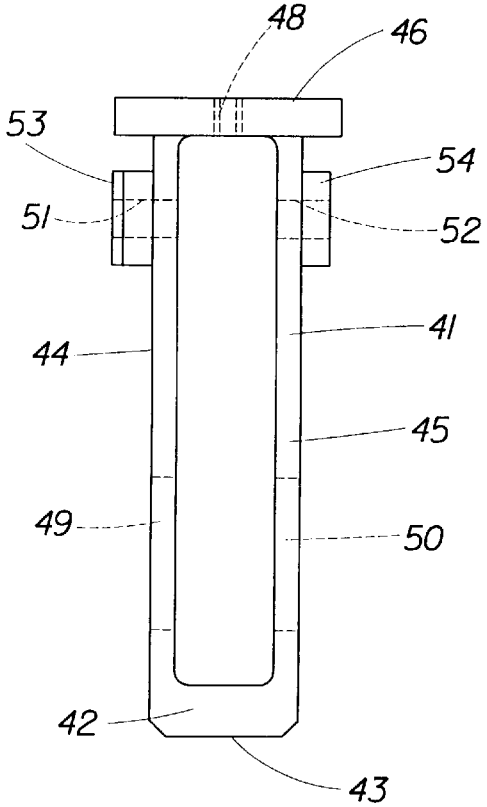
FIG. 10 is a side elevational view of the hammer.

Reference is now made to FIGS. 9, 10 and 11 wherein the hammer 41 is illustrated. As is best shown in FIG. 10, the hammer comprises an elongated U-shaped member having a horizontal base 42 defining the blow imparting surface 43 of hammer 41. A pair of upstanding legs 44 and 45 extend from base 42 and support at their free ends a circular top member 46 for hammer 41. Top member 46 is provided with a pair of threaded bores 47 and 48, the purpose of which will be apparent hereinafter.

Legs 44 and 45 of hammer 41 have formed therein a corresponding pair of obround openings 49 and 50, respectively. As will apparent hereinafter, openings 49 and 50 provide clearance for main shaft 18 (see FIG. 1). In addition, legs 44 and 45 are provided with coaxial perforations 51 and 52 together with bushings 53 and 54 which support the shaft 53 of a cam follower roll 54 mounted between hammer legs 44 and 45 (see FIGS. 1 and 2).

Figure 5:
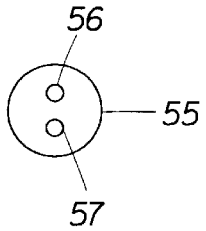
FIG. 5 is a plan view of a spring post of the present invention.

The hammer 41 is completed by the provision of a spring post 55 mounted on its circular top member 46. The spring post 55 is illustrated in FIG. 5 and comprises a disk-like member similar to the circular top member 46 of hammer 41. The spring post 55 has a pair of clearance holes 56 and 57, spaced to be coaxial with the threaded holes 47 and 48 in hammer top member 46. In fact, the spring post is attached to the hammer top member 46 by a pair of screws extending through holes 56 and 57 and threadedly engaged in holes 47 and 48. The spring post differs from the top member 46 of hammer 41 only in that it is of lesser diameter. Spring post 55 is shown mounted on hammer top member 46 in FIG. 9. The hammer top member 46 serves as a spring seat for compression spring 58 (see FIG. 3) and the spring post 55 centers spring 58 on top member 46.

Figure 4:
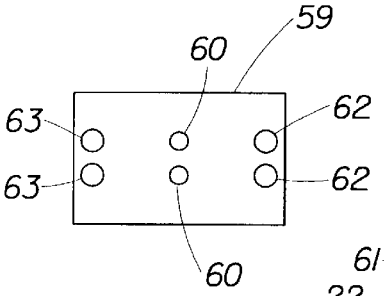
FIG. 4 is a plan view of the spring cap.

Compression spring 58, at its upper end, abuts a rectangular, plate-like spring cap 59, illustrated in FIGS. 3 and 4. Spring cap 59 is provided with a pair of intermediate holes 60. The holes 60 match up with the holes in a second spring post 61, identical to spring post 55 so that second spring post 61 can be affixed to spring cap 59 by machine screws, one of which is shown at 60*a*. Spring cap 59 provides a seat for the upper end of spring 58 and the second spring post 61 centers the upper end of spring 58 on that seat.

Spring cap 59 is provided with a pair of holes 62. The holes 62 receive a pair of machine screws (one of which is shown at 62*a*). These machine screws threadedly engage in threaded bores 21*a* and 21*b* of spacer block 21 (see also FIG. 8). In a similar fashion, the spring cap 59 is provided with another pair of bores 63 adapted to receive machine screws (one of which is shown at 63*a*). These machine screws are threadedly engaged in an identical manner in spacer bar 22. These two outboard pairs of machine screws enable spring cap 59 to be vertically adjusted allowing adjustment of compression spring 58.

Figure 14:
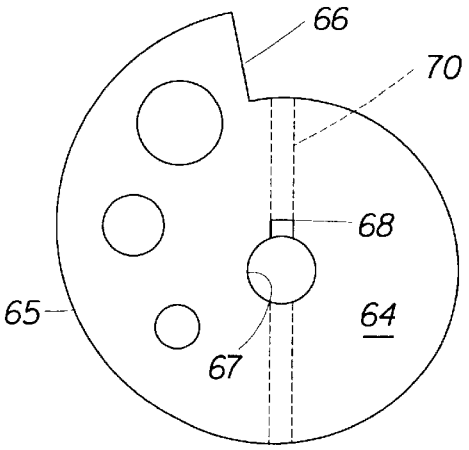
FIG. 14 is a front elevational view of the cam wheel.

Reference is now made to FIG. 14 wherein a cam wheel 64 is illustrated. Cam wheel 64 is provided with a peripheral cam surface 65 which terminates in a drop off or step 66.

Figure 15:
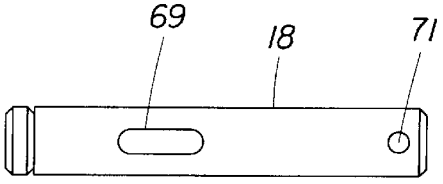
FIG. 15 is a plan view of the main shaft.

Cam wheel 64 is provided with a transverse bore 67 provided with a transverse key way 68. FIG. 15 illustrates the main shaft 18 (see also FIG. 1). Main shaft 18 is provided with a key slot 69 adapted to receive a key (not shown) which is shiftable longitudinally in slot 69. In this way, cam wheel 64 is non-rotatively affixed to main shaft 18. When cam 64 is properly located on main shaft 18, a set screw (not shown) is threaded into a threaded bore 70 in cam wheel 64 until it touches and locks cam wheel 64 from longitudinal movement along main shaft 18. Main shaft 18 is also provided with a threaded bore 71 by which gear 17 is non-rotatively locked in pace on main shaft 18 (see FIG. 1) with a set screw.

It will be noted that front frame 19 is provided with a central hole 72 and rear frame 20 is provided with a central hole 73. When the frame members are assembled together, holes 72 and 73 are adapted to receive bushings 74 and 75, respectively, in which main shaft 18 is mounted. It will be noted that cam wheel 64 is centered between the legs 44 and 45 of hammer 41. The shaft passes through obright openings 49 and 50. This enables hammer 41 to shift vertically without interfering with main shaft 18. Holes 51 and 52 in hammer legs 44 and 45, together with bushings 53 and 54 are adapted to rotatively mount the shaft 76 of a cam follower wheel 77.

As will be apparent from the above description, as the cam is turned by motor 8 in a counter-clockwise direction (as viewed in FIG. 3) the cam follower will cause the hammer to shift upwardly against the action of compression spring 58. Again, the hammer 41 is capable of upward movement since the main shaft 18, bearing cam wheel 64 passes through obround holes 49 and 50 in hammer legs 44 and 45. FIG. 3 shows the hammer at its highest position. When the cam wheel step 66 passes out from under cam follower wheel 77, the hammer will drop sharply and forcefully under the influence of compression spring 58. Cam follower wheel 77 will not contact cam wheel at the time of the hammer drop. Thereafter, the process will repeat itself as long as the tool is actuated.

Figure 17:
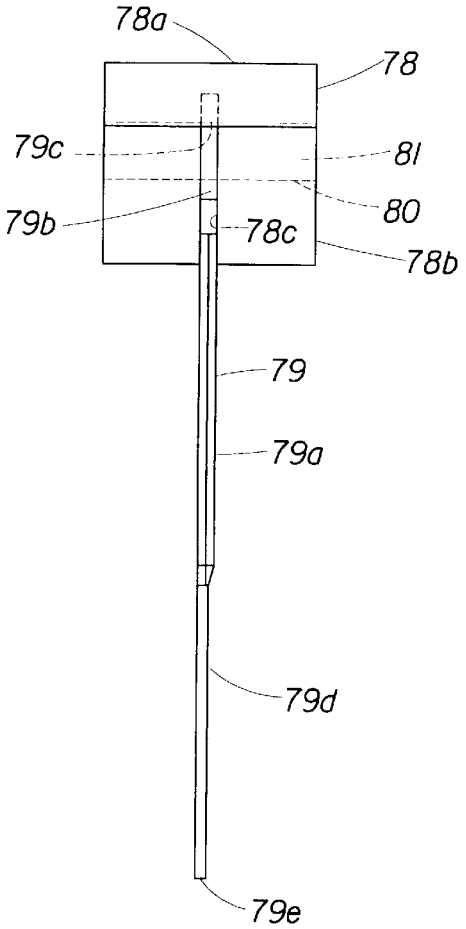
FIG. 17 is a right side elevational view of the chuck and driver.
Figure 16:
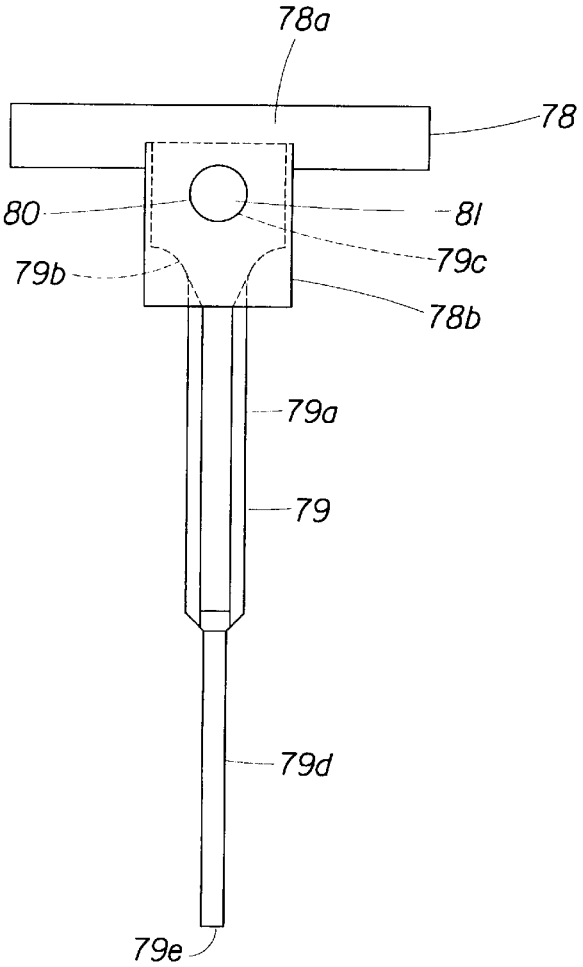
FIG. 16 is a front elevational view of the chuck and driver.

Reference is now made to FIGS. 16 and 17. These Figures illustrate the chuck 78 and the driver 79 of the tool of the present invention. In front elevation, the chuck is T-shaped having an upper elongated rectangular plate-like portion 78*a* and a central, downwardly depending, block-like portion 78*b*. Block-like portion 78*b* has a centrally located transverse notch 78*c* formed therein (see FIG. 17). The notch 78*c* extends partway into chuck portion 78*a*. The chuck 78 is also provided with a bore 80 which extends primarily through chuck portion 78*b* from the front thereof to the rear thereof.

Driver 79 has an elongated body 79*a* with beveled side edges. At one end, body portion 79*a* terminates in a widened substantially rectangular head portion 79*b* provided with a hole 79*c* therein. The driver 79 terminates at its other end in an elongated, rectilinear narrow portion 79*d* ending in a free end constituting a fastener driving surface 79*e*.

FIGS. 16 and 17 show the assembly of the driver 79 and chuck 78. The head portion 79*b* of driver 79 is just nicely received in the chuck slot 78*c*. The perforation 80 of chuck portion 78*b* is coaxial and of the same diameter as the hole 79*c* of driver 79. A pin 81 is introduced into and through the holes 80 and 79*c* to lock driver 79 in chuck 78. Cooperation of the uppermost end of driver 79 with the uppermost end of slot 78*c* precludes rotation of driver 79 about pin 81.

Reference is now made to FIG. 3. It will be noted that the upper portion 78*a* of chuck 78 just nicely fits between the vertical portions of stops 23 and 28. The uppermost position of the chuck/driver assembly is determined by abutment of the upper portion 78*a* of chuck 78 against the upper horizontal portions of stops 23 and 28. The lowermost position of the chuck/driver assembly is determined by the resilient seats 23*d* and 28*a* of the stops 23 and 28. Thus, the range of vertical motion of the chuck/driver assembly is determined by the upper and lower horizontal portions of stops 23 and 28. Horizontal movement of the chuck/driver assembly is precluded by stops 23 and 28, and by front frame 19 and rear frame 20. The lower end portion 79*d* of driver 79 is contained within drive track of guide body to be described hereinafter and shown in FIG. 3 in its lowermost position.

Reference is now made to FIGS. 19–23 wherein the guide block is illustrated. The guide block is generally indicated at 82. The guide block may be made of any appropriate material. Excellent results have been achieved when the guide block is made of synthetic resinous plastic material such as Delrin® manufactured by E.I.DuPont DeNemorrs & Company of Wilmington, Del.

Figure 19:
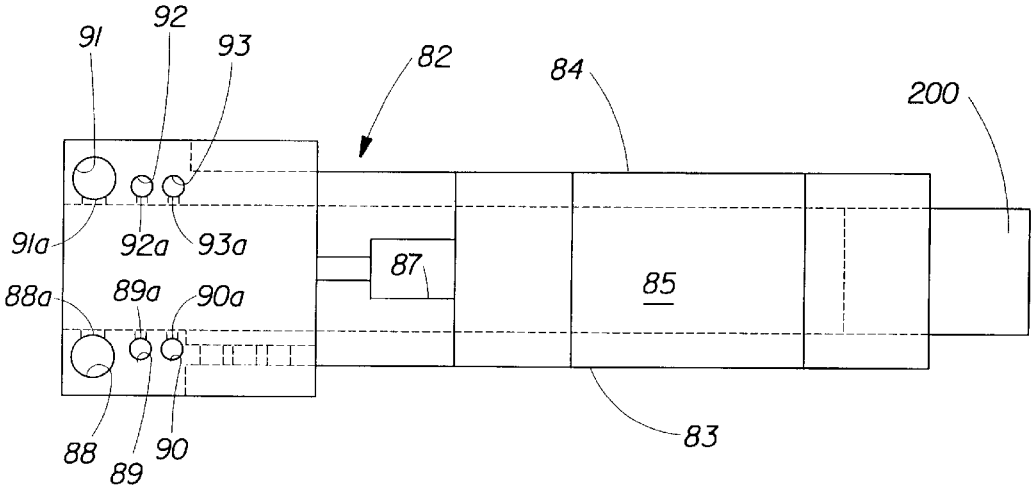
FIG. 19 is a top view of the guide block.
Figure 20:
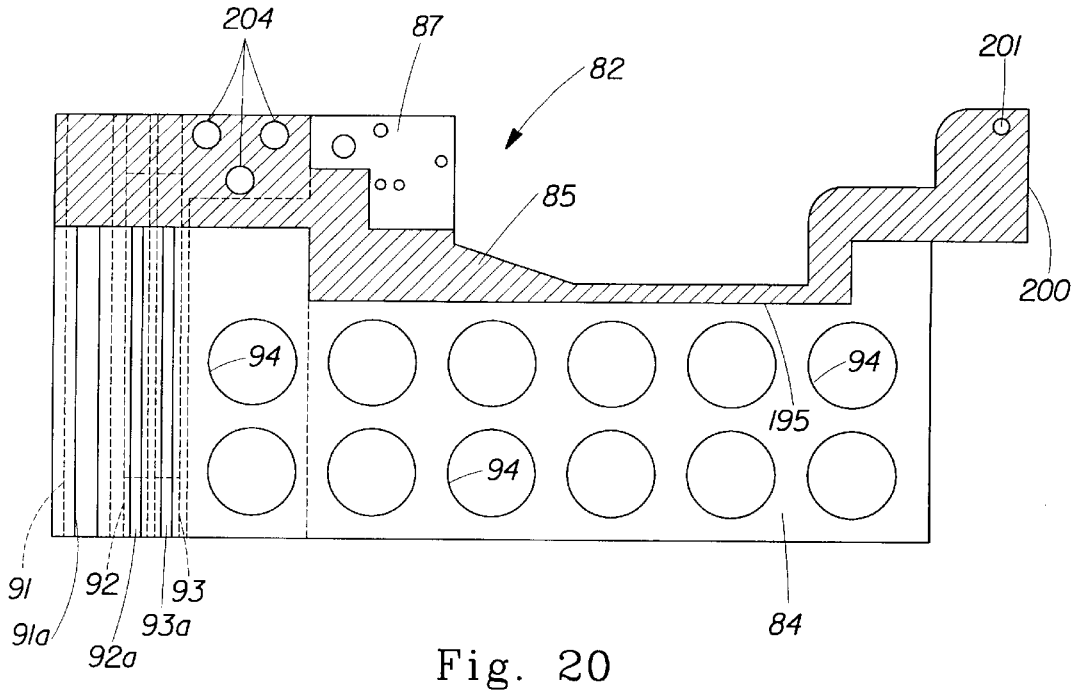
FIG. 20 is a longitudinal cross-sectional view of the guide block illustrating the inside surface of the right wall thereof.
Figure 21:
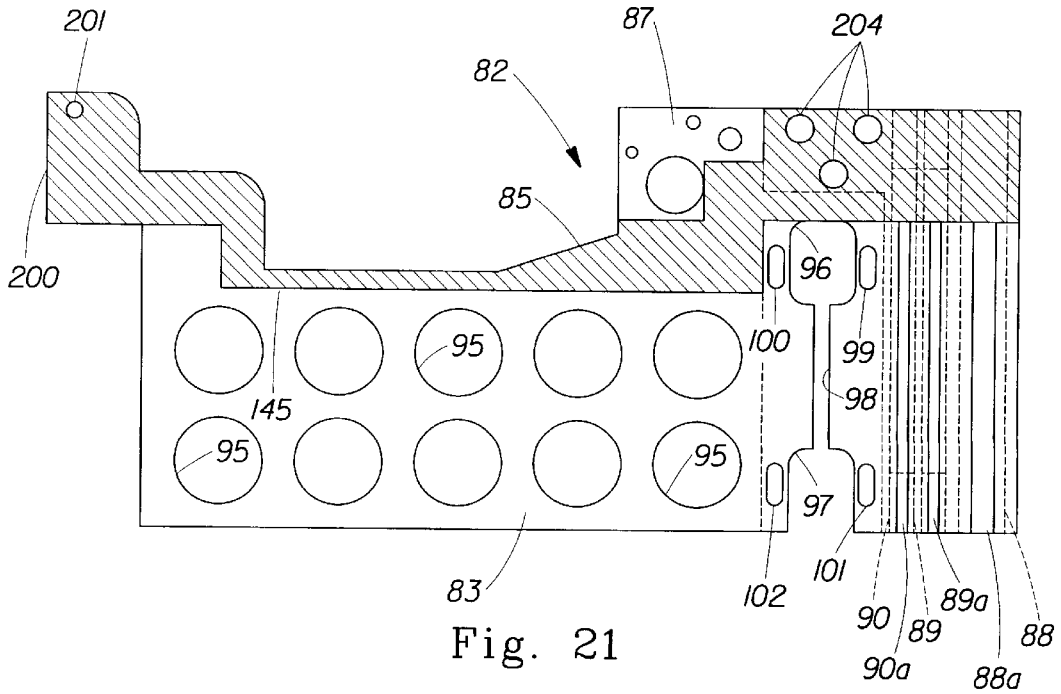
FIG. 21 is a longitudinal cross-sectional view of the guide block illustrating the inside surface of the left wall thereof.
Figure 22:
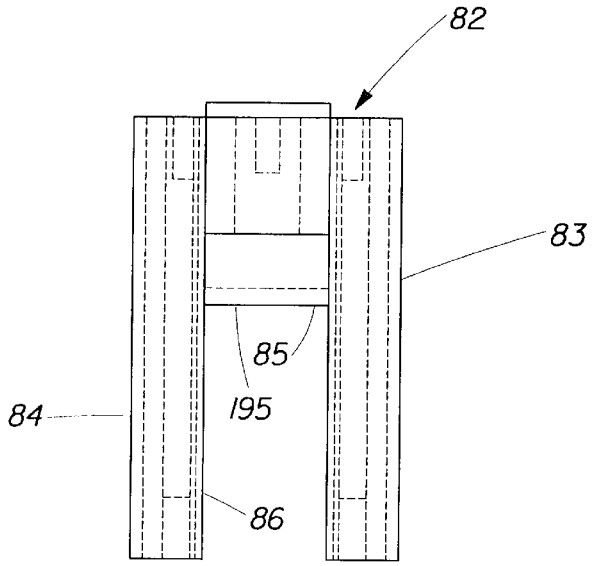
FIG. 22 is a front elevational view of the guide block.
Figure 23:
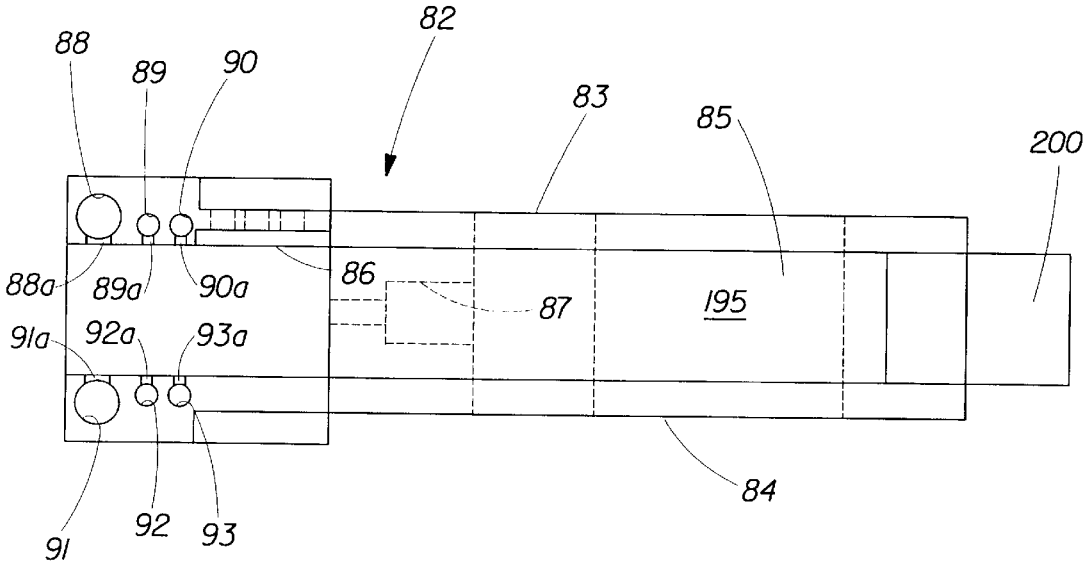
FIG. 23 is a bottom view of the guide block.

As is most clearly shown in FIG. 22, guide block 82 is made up of a pair of side members 83 and 84 maintained in parallel spaced relationship by an intermediate portion 85. As a result, the guide block 82 provides a channel 86 for receipt of the magazine 6, to be described. As is best shown in FIGS. 19, 20 and 21, the guide block intermediate position has a notch 87 adapted to accommodate and mount trigger 7 and its mechanism.

Side member 83 of guide block 82 has, near its forward end, three bores 88, 89 and 90 which extend from the top of side member 83 through its bottom. It will be noted that bore 88 is larger than bores 89 and 90 and bores 89 and 90 are of the same diameter. An identical set of bores 91, 92 and 93 are provided in side member 84. It will be noted that bores 88, 89 and 90 communicate with channel 86 through slots 88*a*, 89*a* and 90*a*, respectively. Similarly, the bores 91, 92 and 93 in leg portion 84 communicate with channel 86 through slots 91*a*, 92*a* and 93*a*, respectively. The purpose of the bores and their respective channels will be apparent hereinafter.

Figure 18:
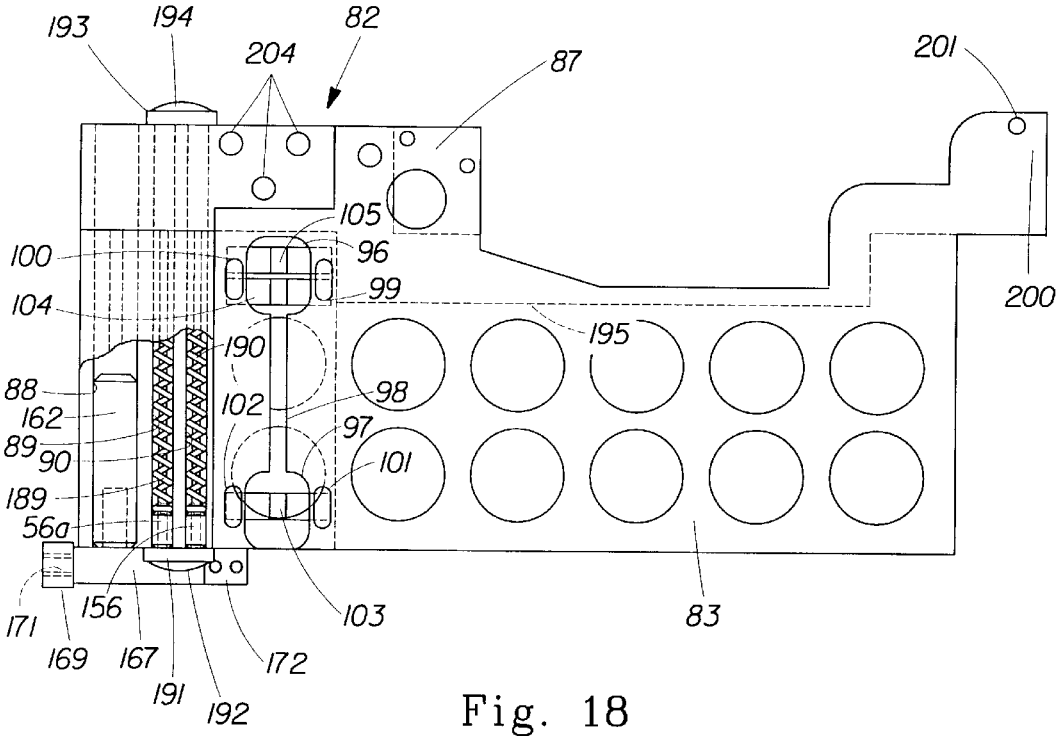
FIG. 18 is a left side elevational view, partly in cross-section, of the guide block of the present invention.

Side member 84 of guide block 82 is provided with 12 holes 94 primarily for weight reduction. Side members 83 and 84 are substantially mirror images of each other with one exception. Side member 83 is provided with only 10 holes 95 equivalent to the holes 94 of side member 84. The forwardmost pair of holes 94 in side member 84 are replaced in side member 83 by a pair of openings 96 and 97 joined by a slot 98. Opening 96 is flanked by a pair of elongated slots 99 and 100. In similar fashion, opening 97 is flanked by a pair of slots 101 and 102. As is best shown in FIG. 18, a photo-interrupter switch is mounted on the inside surface of wall member 83 by means of screws passing through elongated slots 101 and 102. The elongated slots enable vertical adjustment of the switch 103 (as viewed in FIG. 18). The central portion of switch 103 is exposed through opening 97. In a similar fashion, a second photo-interrupter switch 104 and in some instances a third photo-interrupter switch 105 may be mounted on the inside surface of leg member 83 with central portion of switch 104, or the central portions of switches 104 and 105, being exposed through opening 96. The purpose of the photo-interrupter switches will be set forth hereinafter.

Figure 24:
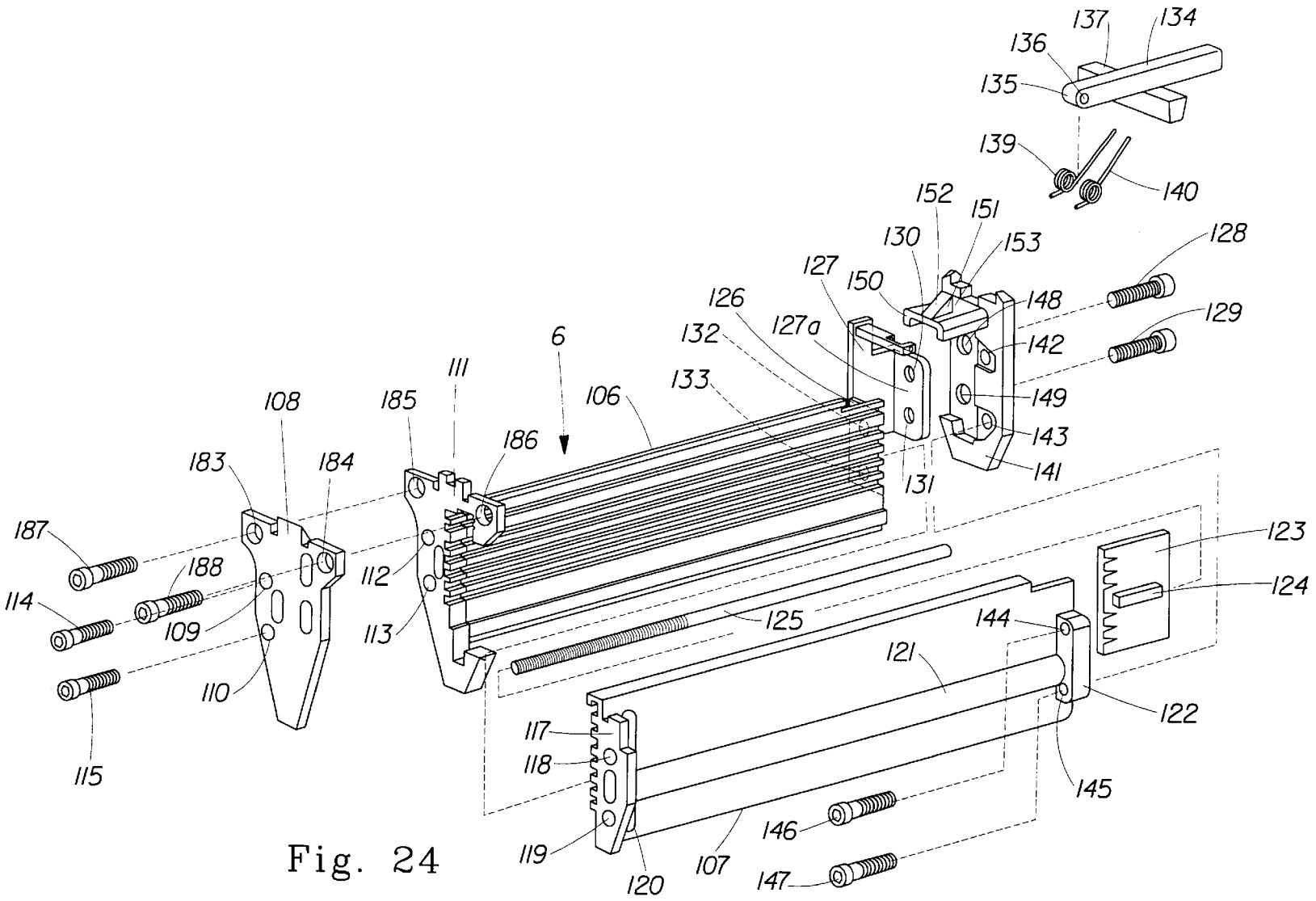
FIG. 24 is an exploded perspective view of the magazine of the present invention.
Figure 25:
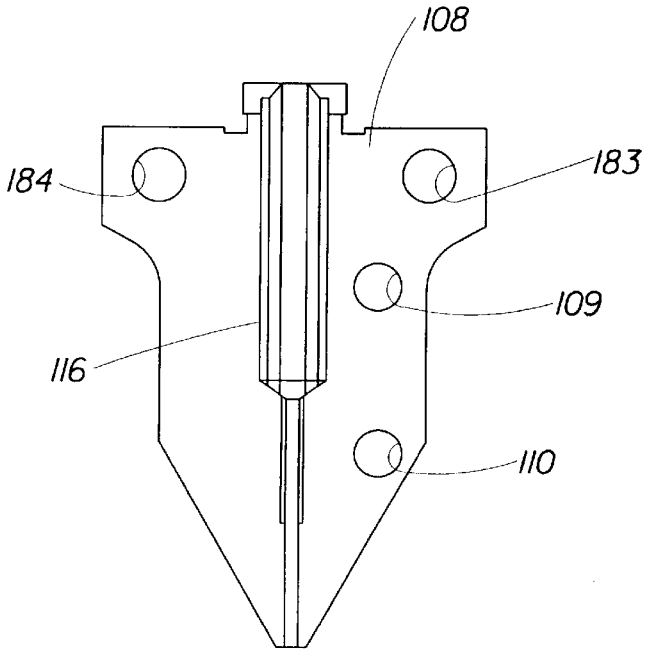
FIG. 25 is a rear elevational view of the fixed front plate of the magazine.
Figure 26:
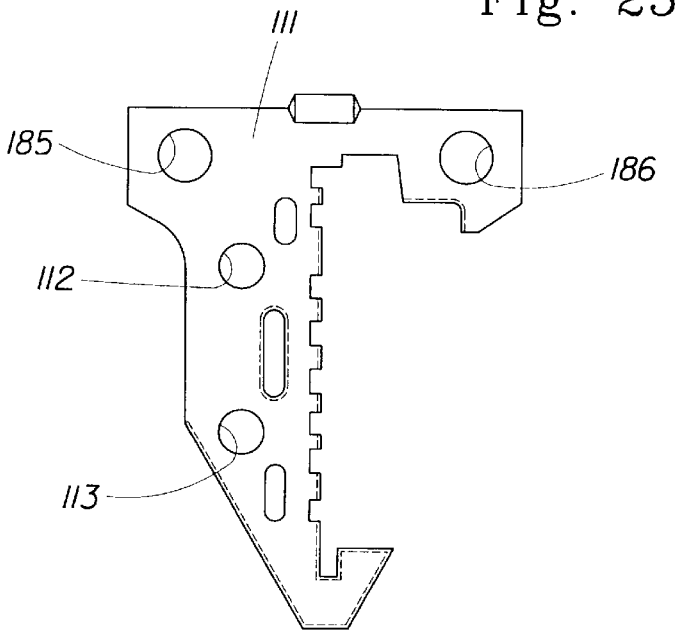
FIG. 26 is a front elevational view of the fixed back plate of the magazine.
Figure 27:
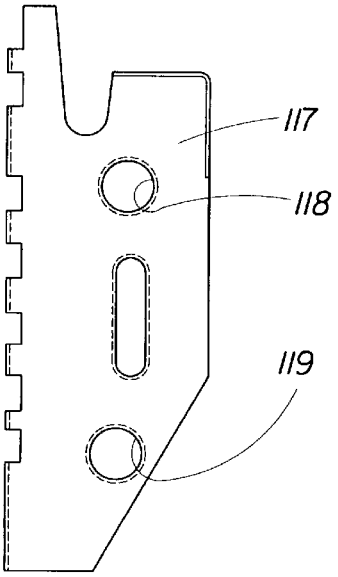
FIG. 27 is a front elevational view of the movable back plate of the magazine.

Reference is now made to FIG. 24 illustrating the magazine 6 of the present invention. Magazine 6 has a fixed body portion 106 and a movable body portion 107. Movable body portion 107 is slidably mounted on fixed body portion 106 and is shiftable thereon between a closed position and a rearwardly retracted position enabling fasteners to be loaded in magazine 6. A fixed front plate 108 is provided with a pair of bores 109 and 110. A fixed back plate 111 is provided with a corresponding pair of bores 112 and 113. A machine screw 114 passes through fixed front plate bore 109 and fixed back plate bore 112 and is threadedly engaged in a laterally extending lug at the forward end of fixed body portion 106. In a similar fashion, machine screw 115 passes through fixed front plate bore 110 and fixed back plate bore 113 and is threadedly engaged in the forward end of fixed magazine body portion 106. Fixed front plate 108 and fixed back plate 111 are shown in FIGS. 25 and 26, respectively. It will be noted that fixed front plate 108 has a drive track 116 formed in its rear surface. A movable back plate 117 (see FIGS. 24 and 27), is affixed to a laterally extending lug 120 on the movable magazine body part by means of machine screws (not shown) passing through the lug and threadedly engaged in holes 118 and 119 in the movable back plate 117. When movable magazine body portion 107 is in its forwardmost closed position, the fixed back plate 111 and the movable back plate 117 complete drive track 116. The fixed front plate 108, the fixed back plate 111 and the movable back plate 117, when assembled together, constitute the guide body 108*a* containing drive track 116.

The movable magazine body portion 107 has a longitudinally directed lateral bulge or extension 121 located between lug 120 and lug 122. On the inside surface of the movable magazine body portion 107, this extension accommodates a longitudinal slot (not shown). The magazine is provided with a substantially planar feeder shoe 123 having a lug 124 thereon which is just nicely and slidably received in the aforementioned longitudinal slot. Also receivable within that slot, behind the feeder shoe lug 124 is an elongated spring 125. Spring 125 serves to constantly urge the feeder shoe 123 forwardly. This in turn causes the feeder shoe to urge a row of fasteners within the magazine forwardly, the forwardmost fastener entering drive track 116.

The rearwardmost end of the fixed magazine body portion 106 is provided with a laterally extending lug 126 to which a latch mount 127 is affixed by a pair of machine screws 128 and 129. The screws 128 and 129 pass through perforations 130 and 131 in the mounting plate portion 127*a* of latch mount 127 and into threaded perforations 132 and 133 of lug 126.

Figure 30:
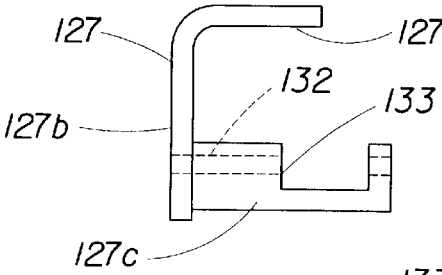
FIG. 30 is a plan view of the latch mount.
Figure 28:
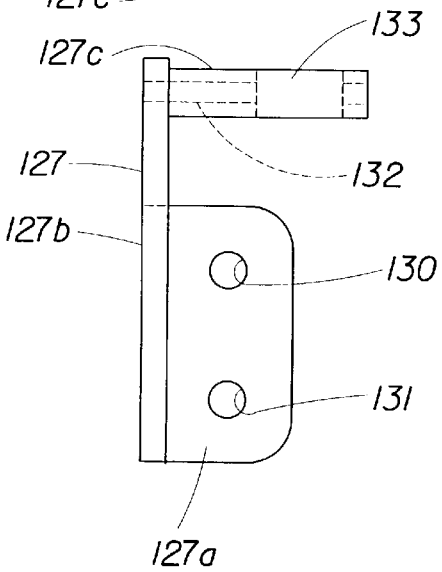
FIG. 28 is a front view of the latch mount.
Figure 29:
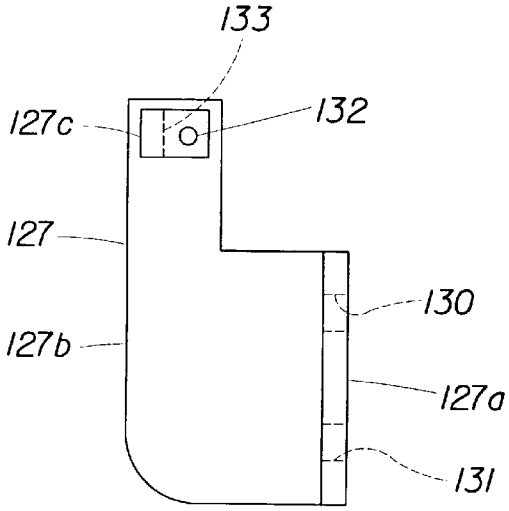
FIG. 29 is a left side elevational view of the latch mount.

Latch mount 127 is most clearly shown in FIGS. 28, 29 and 30. Latch mount 127 has a forwardly extending portion 127*b* extending at right angles to mounting portion 127*a*. Forwardly extending portion 127*b* has an upwardly directed portion to which is attached a transverse member 127*c*. As is most clearly shown in FIGS. 28 and 30, transverse member 127*c* has a longitudinal bore 132 which extends the length of transverse member 127*c* and through the upwardly extending part of forwardly extending portion 127*b*. The bore 132 is interrupted by a notch 133 formed in member 127*c*.

Figure 31:
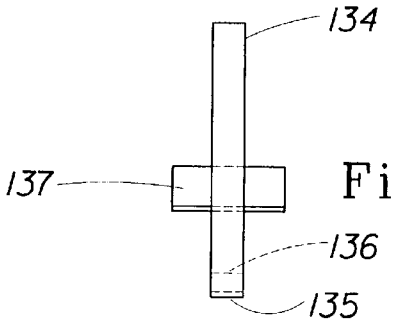
FIG. 31 is a top view of the latch of the present invention.
Figure 32:
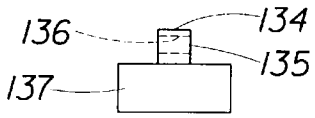
FIG. 32 is a front view of the latch.
Figure 33:
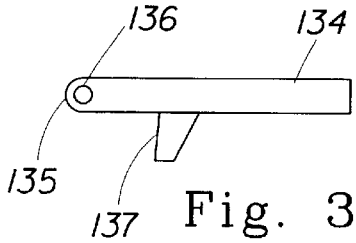
FIG. 33 is a left side elevational view of the latch.

The latch member itself is illustrated in FIGS. 31–33 and is indicated at 134. The latch member 134 has a rounded forward end 135 containing a transverse bore 136. Latch member 134 carries a downwardly depending latch element 137. As is most clearly shown in FIGS. 31 and 32, extends laterally beyond either side of latch member 134.

Reference is made to FIGS. 1 and 24. Latch member 134 is pivotally mounted within the notch 133 of latch mount 127 by a pivot pin 138 located in latch mount bore 132. The pivot pin also passes through the coils of a pair of torsion springs 139 and 140 located to either side of latch member 134 within notch 133. The torsion springs 139 and 140 constantly urge latch member 134 to its locking position shown in FIG. 1.

As is shown in FIG. 24, the magazine 6 is completed by a rear end closure 141. Rear end closure 141 is provided with a pair of threaded holes 142 and 143. The rear lug 122 on movable magazine body portion 107 is provided with clearance bores 144 and 145. A pair of machine screws 146 and 147 pass through the clearance bores 144 and 145 of lug 122 and are threadedly engaged in the bores 142 and 143 of rear end closure 141. Thus, when the movable body portion 107 of magazine 6 is in its forwardmost, closed position, the rear end closure member 141 abuts the rearward end of the fixed body portion 106 of magazine 6. The rear end closure 141 is provided with a pair of clearance holes 148 and 149 adapted to accommodate the heads of the machine screws 128 and 129 which attach the latch mount 127 to the fixed body portion 106 of the magazine 6.

It will be noted that the rear end closure has, an extension 150 on its upper forward face which overlies the rearward ends of magazine body portions 106 and 107 when body portion 107 is in its closed position. The extension 150 is provided with a catch 151 having an upwardly and rearwardly sloping surface 152 terminating in a vertical surface 153. Thus, as the movable magazine body part 107 is shifted to its closed position, the latch element 137 will slide along the upwardly and rearwardly sloping surface 152 of catch 151 until it reaches the end thereof, whereupon the torsion springs 139 and 140 will cause the latch element 137 to fall and engage catch 151, locking the movable body portion 107 of the magazine in its closed position, as shown in FIG. 1.

Figure 34:
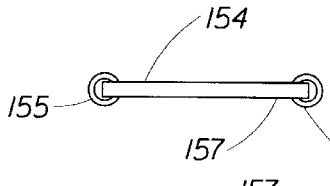
FIG. 34 is a plan view of a spring bridge of the present invention.
Figure 35:
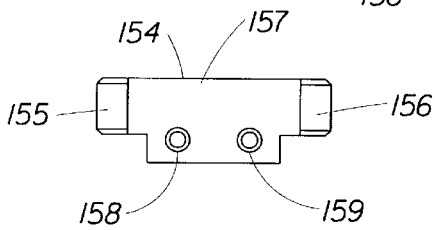
FIG. 35 is a front elevational view of the spring bridge of FIG. 28.

Reference is now made to FIGS. 34 and 35 which illustrate a spring seat and bridge assembly, indicated at 154. The spring seat and bridge assembly comprises a pair of rod-like spring seats 155 and 156 interconnected by a bridge member 157 to which they are attached. The bridge member 157 has a pair of clearance holes 158 and 159 extending therethrough.

Figure 36:
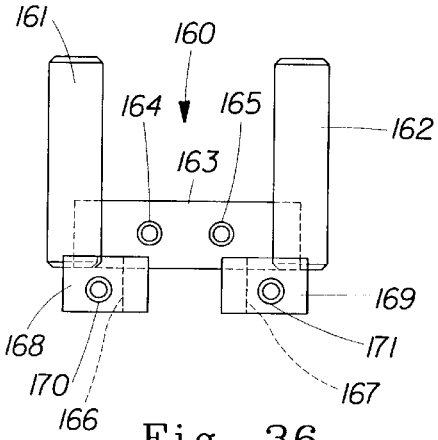
FIG. 36 is a front elevational view of the magazine guide of the present invention.
Figure 37:
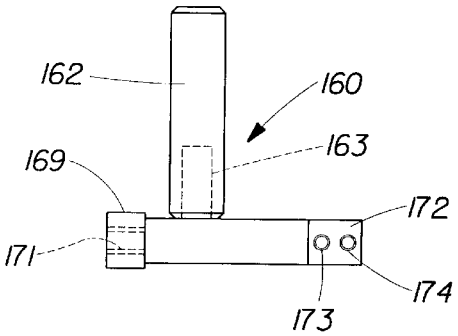
FIG. 37 is a left side elevational view of the magazine guide of FIG. 30.
Figure 38:
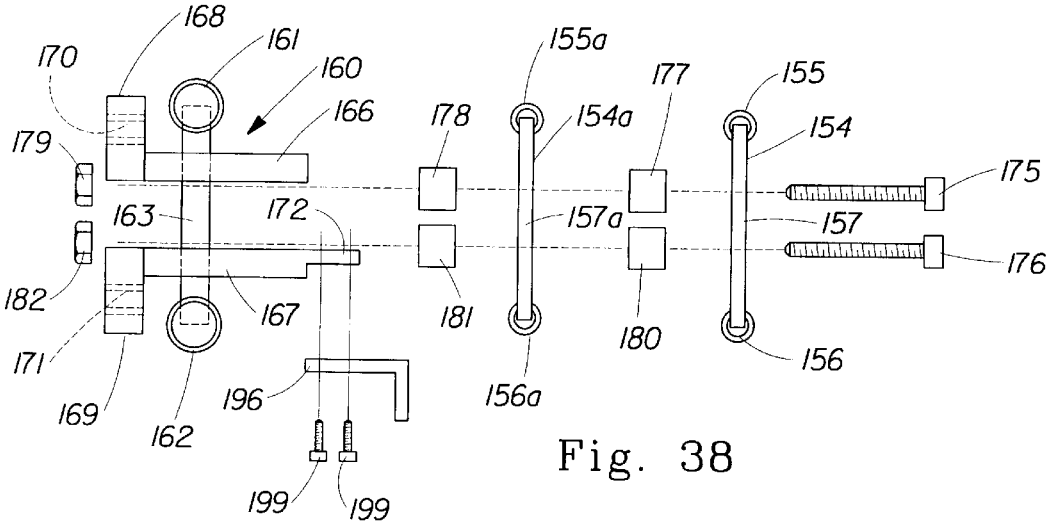
FIG. 38 is an exploded plan view illustrating the complete assembly of the magazine guide of the present invention.

FIGS. 36, 37 and 38 illustrate the magazine guide assembly generally indicated at 160. The magazine guide assembly comprises a pair of guide rods 161 and 162 affixed to the ends of a bridge 163. The bridge 163 is provided with a pair of threaded bores 164 and 165 which correspond to the clearance bores 158 and 159 in the bridge 157 of the spring seat and bridge assembly 154. As is most clearly shown in FIGS. 36 and 38, the bridge 163 of the magazine guide assembly 160 is affixed to a pair of brace members 166 and 167 arranged in parallel spaced relationship and extending perpendicularly to bridge 163. The forward ends of brace members 166 and 167 have laterally extending additions 168 and 169 affixed thereto, respectively. The additions 168 and 169 have threaded bores 170 and 171 formed therein, respectively.

Brace members 166 and 167 are identical, with the exception that brace member 167 has a narrow extension 172 provided with a pair of threaded bores 173 and 174. The purpose of extension 172 and its threaded bores 173 and 174 will be apparent hereinafter.

The spring seat and bridge assembly 154 of FIGS. 34 and 35, together with an identical spring seat and bridge assembly 154*a* are shiftably mounted on brace members 166 and 167 by a pair of machine screws 175 and 176. Machine screw 175 passes through the clearance bore 158 of spring seat and bridge assembly 154, a tubular spacer 177, a corresponding clearance hole in spring seat and bridge assembly 154*a,* and a second spacer 178. Thereafter, machine screw 175 is threadedly engaged through threaded bore 164 of bridge 163 and is provided with a jam nut 179. In the same manner, machine screw 176 is caused to pass through clearance hole 159 of spring seat and bridge assembly 154, a spacer 180, a corresponding hole in bridge 157*a* of spring seat and bridge assembly 154*a,* and through a second spacer 181. Thereafter, machine screw 176 is threadedly engaged through the threaded bore 165 of bridge 163 of the magazine guide assembly 160 and is provided with a jam nut 182. The completed assembly of FIG. 38 constitutes a guide and biasing system for magazine 6 to guide the vertical movement of the magazine and to bias the magazine to its extended position illustrated in FIG. 1. Reference is made to FIG. 24. It will be noted that fixed front plate 108 has at its upper end a pair of clearance bores 183 and 184. Similarly, the fixed rear plate 111 has a corresponding pair of clearance bores near its upper end as at 185 and 186. A machine screw 187 passes through fixed front plate bore 183 and fixed rear plate bore 185 and is threadedly engaged in bore 170 of the magazine guide assembly of FIG. 36. Similarly, machine screw 188 passes through fixed front plate bore 184, fixed rear plate bore 186 and is threadedly engaged in bore 171 of magazine guide assembly 160. Thus, the guide and biasing system of FIG. 38 is firmly attached to magazine 6.

Reference is now made to FIG. 18. FIG. 18 shows the guide and biasing system of FIG. 38 in its lowermost position with respect to guide block 82. It will be noted that guide rod 162 is slidably received in guide block bore 88. It will be understood that guide rod 161 will similarly be received in guide block bore 91. Slots 88*a* and 91*a* accommodate the bridge 163 between guide rods 161 and 162. In a similar fashion, spring seats 156*a* and 155*a* are received within guide block bores 89 and 92, respectively, with the bridge 157*a* therebetween accommodated by guide block slots 89*a* and 92*a*. Spring seats 156 and 155 of spring seat and bridge assembly 154 are received in bores 90 and 93, with the bridge 157 therebetween being accommodated by guide block slots 90*a* and 93*a*. Guide rods 162 and 161 cooperate with guide block perforations 88 and 91 to assure that the magazine 6 remains level and appropriately oriented with respect to guide block 82 throughout the vertical travel of the magazine.

It will be noted from FIG. 18 that bore 89 is provided with a compression spring 189. In a similar fashion, bore 90 is provided with a compression spring 190. Spring seat 156*a* of spring seat and bridge assembly 154*a* serves as a movable lower seat for spring 189. Similarly, spring seat 156 of spring seat and bridge assembly 154 serves as a movable seat for spring 190. Spring seats 156*a* and 156 are precluded from coming out bores 89 and 90, respectively, not only by brace members 166 and 167 of the guide and biasing system, but also by a closure plate affixed to the bottom edge of the leg member 83 of guide block 82. In a similar fashion, a spring seat plate 193 covers the upper ends of bores 89 and 90 and is held in place by a screw 194. It will be understood that guide block bores 92 and 93 will similarly be provided with springs (not shown) together with plates and screws equivalent to plates 191 and 193 and screws 192 and 194.

The retracted or uppermost position of the magazine 6 with respect to guide block 82 is determined by the abutment of magazine 6 against the bottom surface 195 of the intermediate portion 85 of guide block 82. The lowermost position of magazine 6 is determined by abutment of spring seats 156 and 156*a* against stop plate 191 together with the simultaneous abutment of a similar stop plate (not shown) provided for spring seats 155 and 155*a*.

Figure 39:
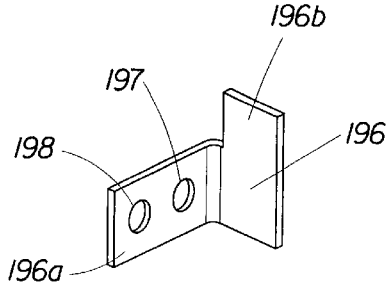
FIG. 39 is a perspective view of the flag of the present invention.

FIG. 39 illustrates the flag 196 of the present invention. The flag 196 comprises a mounting portion 196*a* and a switch actuating portion 196*b* oriented at right angles with respect to each other. The mounting portion has a pair of clearance holes 197 and 198 which correspond to the threaded bores 172 and 173 of the magazine guide assembly (see FIG. 37). The flag mounting portion 196*a* is attached to brace member 167 by screws 199. Flag 196 cooperates with photo-interrupter switch 103 to shut off motor 8 when magazine 6 is in its lowermost position (see FIG. 1). When the magazine shifts to its retracted position, the actuator portion 196*b* of flag 196 moves upwardly through slot 198, to cooperate with photo-interrupter switch 104 to turn off motor 8. The purpose of this switch will be apparent hereinafter.

Figure 40:
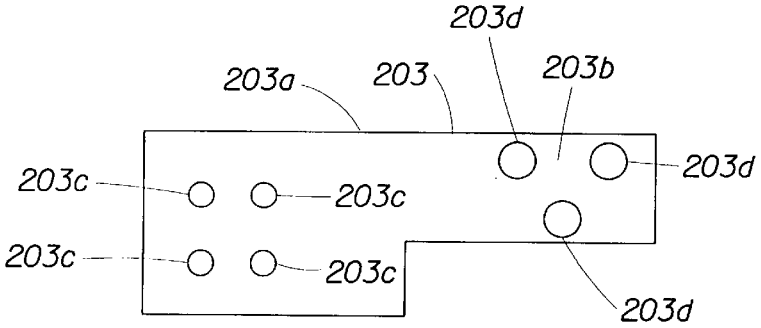
FIG. 40 is a left side elevational view of a side plate of the present invention.

Guide block 82 (and thus magazine 6) is attached to tool 1 in the following manner. The rearward end of the guide block 82 has an upstanding extension 200 provided with a bore 201. The handle portion 3 of tool 1 is provided with a bore 202. When the bores 201 and 202 are positioned to be coaxial, a pin is located through both, attaching the rearward end of the guide block 82 to the rearward end of handle 3. The forward end of guide block 82 is attached to the forward portion of the tool by a pair of identical side plates, one of which is shown at 203 in FIG. 40. Side plate 203 has a front portion 203*a* and a rear portion 203*b*. The front portion 203*a* has four clearance bores 203*c* which correspond to the four threaded bores 25 of the right stop 23. Machine screws (not shown) passing through clearance bores 203*c* and threadedly engaged in stop bores 25 attach plate 203 to stop 23 (see FIG. 1). The rearward portion 203*b* of side plate 203 is provided with three clearance holes 203*d*. These holes correspond to holes 204 in guide block 82 and enable the attachment of the rearward portion of side plate 203 to the guide block 82. It will be understood that the second identical side plate attaches the guide block 82 to stop 28 in an identical manner.

Finally, reference is made to FIG. 1. Trigger 7 is pivotally mounted in a notch 89 formed in guide block 82. Trigger 7 is biased to its unactuated position by a torsion spring 205. When trigger 7 is shifted to its actuated position, it will, in turn, actuate a trigger switch 206.

The tool 1 of the present invention has been described and illustrated in the form of a brad or nail driving tool. These fasteners may or may not be headed and may range in length from ⅜" to 3.5". As would be obvious to one skilled in the art, appropriate changes in driver 79 and drive track 116 and magazine 6 would enable the driving of staples or other appropriate fasteners. It would be within the scope of the invention to provide tool 1 with interchangeable drivers, front plates and magazines.

Figure 41:
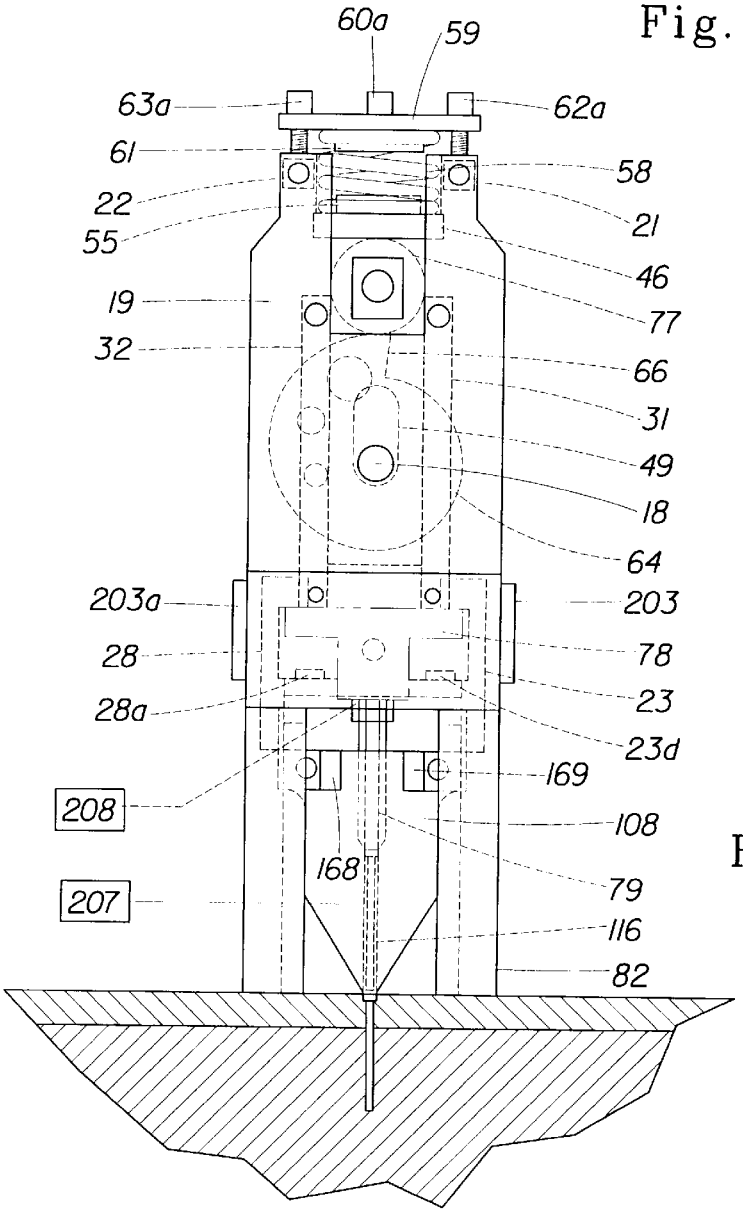
FIG. 41 is a simplified front elevational view of the tool of the present invention with the hammer in its uppermost position.
Figure 42:
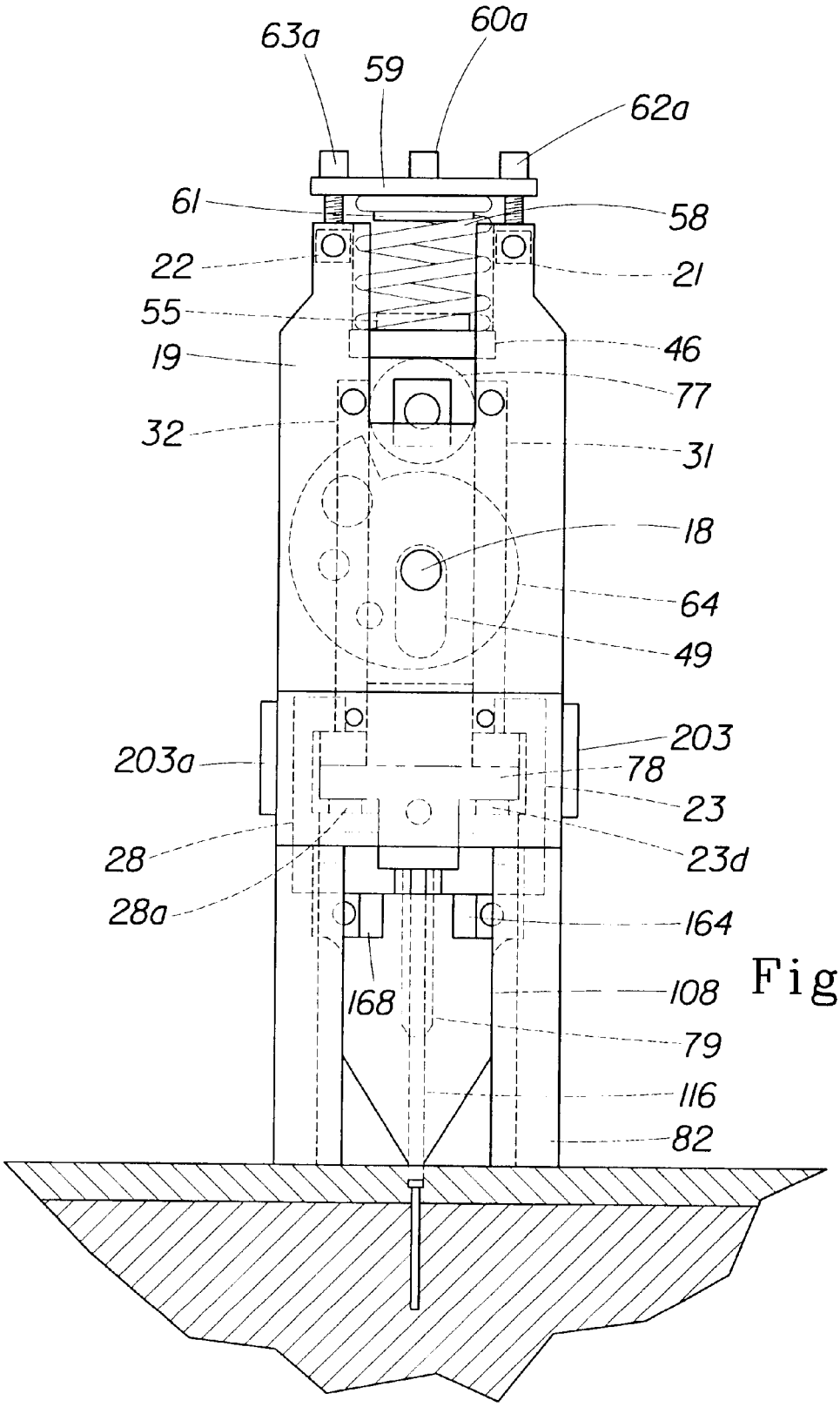
FIG. 42 is a simplified front elevational view, similar to FIG. 41, but illustrating the hammer in its lowermost position.

The motor 8 turns cam wheel 64 in a counterclockwise direction, as viewed in FIGS. 41 and 42. FIG. 41 shows the position of the parts when cam wheel 64 has raised the cam follower 77 and thus the hammer 41 to its maximum retracted position against the action of spring 58. FIG. 42 shows the hammer 41 in its lowermost position the cam wheel step 66 having passed beneath cam follower 77. For each blow, the hammer is lifted by cam wheel 64 and follower 77 about ⅛" and drops about ⅛" under the influence of spring 58.

As indicated above, the force of spring 58 is adjustable by the machine screws 62*a* and 63*a*. Usually, the screws 62*a* and 63*a* are used to preload spring 58 against hammer 41 by about 10 pounds. It is desired that the force on the nail does not go to 0 until the velocity goes to 0.

The system of the present invention avoids high loads on cam wheel camming surface 65. As will be evident from FIG. 42, when the hammer is driven downwardly by spring 58, cam follower wheel 77 does not contact cam wheel surface 65 until the cam follower 77 is picked up by the cam wheel 64 after further rotation thereof.

To operate the tool, the operator first releases latch 134, opening magazine 6 and filling it with the desired brad or nail to be used. The magazine is then closed and relatched, and the tool is ready for use. The lowermost portion or nose of the guide body is located on the workpiece at the position in which the brad or nail is to be driven. When slight pressure is applied to the tool, magazine 6 will shift upwardly by sufficient amount to enable the flag to actuate switch 103 (see FIG. 1). The operator will also shift trigger 7 to its actuated position. Actuation of trigger 7 will actuate trigger switch 206. The circuit is such that in order to turn on motor 8, both flag-actuated switch 103 and trigger switch 206 must be actuated. Depressing the guide body against the workpiece to actuate switch 103 and squeezing trigger 7 to actuate trigger switch 206 can be done in any order, so long as both switch 103 and switch 206 are actuated. Each rotation of cam wheel 64 will raise and release hammer 41 resulting in a series of sharp blows applied to the brad or nail by driver 79.

When the brad or nail has been driven, magazine 6 will attain its uppermost position within guide block 82. As a result of this, flag 196 will cooperate with upper photoelectric switch 104 to shut off motor 8. When the tool is lifted from the workpiece and magazine 6 is shifted to its lowermost extended position, the motor will remain off (even if the operator is still maintaining trigger 7 in an actuated position) by cooperation of lower switch 103 and flag 196.

It is preferred that when a nail driving cycle is completed, the nail is countersunk in the workpiece by about 1/16". Generally, no problem is encountered in providing such a countersink when the material of the workpiece is relatively soft and the upper photo-interrupter switch is properly positioned. However, difficulties can be encountered when the workpiece is made of relatively hard material. Under such circumstances, a greater number of blows are required to drive and countersink a fastener than when the workpiece is of softer material. Thus, depending upon the circumstances of use, it may be desirable to provide tool 1 with a depth of drive adjustment. This can be accomplished in a number of ways. In some instances, for example, it may be sufficient simply to adjust the upper switch 104 to its highest position with respect to slots 99 and 100. In some instances, a time delay circuit may be added in association with upper switch 104. The delay, per se, could be operator selectable, or could simply be chosen to provide a delay suitable for average conditions.

Alternatively, it would be within the scope of the invention to provide two upper photo-interrupter switches 104 and 105, as shown in FIG. 18. In this instance, the operator could select which of the photo-interrupter switches 104 or 105 to use, depending upon the nature of the workpiece.

Finally, it would be within the scope of the present invention to provide a photo-interrupter switch in association with the guide body and a flag or interrupter in association with the driver. In FIG. 41, a photo-interrupter switch is diagrammatically indicated by rectangle 207, and the flag or interrupter is diagrammatically indicated by the rectangle 208. Further adjustment could be accomplished by making at least one of the photo-interrupter switch 207, and the flag 208 adjustable as to position. Such a system relies upon the position of the driver with respect to the guide body.

When the nail or brad has been driven and countersunk appropriately, the motor will be automatically turned off by the appropriate one of the photo-interrupter switches. The tool will be lifted from the workpiece and the biasing springs will cause the magazine 6 to shift to its extended position. The tool is now ready for another fastener driving cycle.

Modifications may be made in the invention without departing from the spirit of it.

What is claimed is:

1. An multiple impact fastener driving tool, said tool comprising a handle portion, a main body portion containing an impact assembly, a magazine having a forward end, a guide body containing a drive track at said forward end of said magazine, a guide block affixed to said handle portion and said main body portion, said magazine being shiftable with respect to said guide block between an extended fastener starting position and a retracted fastener driven position, said impact assembly comprising a motor, a cam wheel having a peripheral cam surface with at least one drop-off being rotatable by said motor, a reciprocable hammer, a cam follower roller rotatively mounted on said hammer, said hammer having a first end comprising an impact surface and a second end, a compression spring surmounting and abutting said second end, a fastener driver assembly, a part of said driver assembly being slidable in said drive track, stop members limiting the axial movement of said driver assembly, said hammer being shiftable axially by said cam wheel and cam follower roller away from said driver assembly, said compression spring being compressible by said hammer such that energy is stored therein, said cam follower roller and said hammer being releasable by said cam wheel drop-off, said hammer being shiftable by said stored energy of said compression spring to impart a sharp blow to said driver assembly and thus to a fastener being driven, said hammer, said cam wheel and said cam follower roller being configured to cause the hammer to apply a rapid succession of such blows to said driver assembly until said fastener is fully driven by said driver assembly and said motor is turned off.

2. The tool claimed in claim 1 wherein said cam follower roller is out of contact with said cam wheel peripheral cam surface immediately after said drop off, contact between said cam wheel cam surface and said cam follower roller being reestablished after further rotation of said cam wheel.

3. The tool claimed in claim 1 wherein said stored energy of said compression spring, said hammer and said driver assembly are in line with said fastener to be driven.

4. The tool claimed in claim 1 wherein said compression spring abutting said hammer is itself abutted by a screw mounted spring cap, said cap being tightenable against said compression spring to adjust the energy stored therein and to preload said compression spring against said hammer.

5. The tool claimed in claim 1 wherein said hammer is axially slidable in bearings mounted on a front frame and a rear frame joined together in parallel spaced relationship to form a frame assembly, said hammer comprises a pair of elongated sides in parallel spaced relationship and extending between said hammer ends, said cam wheel being located between said hammer sides, said cam wheel being non-rotatively mounted on a main shaft extending through longitudinal slots in said hammer sides, said main shaft being mounted in bearings in said front and rear frames, by virtue of its longitudinal slots, said hammer being shiftable in its bearings perpendicular to said main shaft, said motor having an output shaft operatively attached to said main shaft to rotate said cam wheel, said cam follower roller being non-rotatively mounted on a shaft rotatively mounted in bearings affixed to said hammer sides, said compression spring being located between said planar end of said hammer and a spring cap affixed to the upper end of said frame assembly by machine screws, said energy stored in said compression spring can be adjusted and said spring can be preloaded against said hammer by adjusting said last mentioned machine screws.

6. The tool claimed in claim 1 wherein said electric motor is connectable to a source of electric energy.

7. The tool claimed in claim 1 wherein said electric motor is energized by a battery pack affixed to said handle portion of said tool.

8. The tool claimed in claim 1 wherein said magazine can accommodate brads and nails having a length range of from about ⅜" to about 3.5".

9. The tool claimed in claim 1 including a guide and biasing system to guide the movement of said magazine with respect to said guide block and to bias said magazine to said fastener start position.

10. The tool claimed in claim 1 including a pair of guide rods operatively attached to said magazine, each of said guide rods being slidable within a first bore in each of said guide block walls to guide said movement of said magazine, said guide block walls each having second and third bores adjacent said first bore therein, a compression spring mounted in each of said second and said third bores, a rod like spring seat for each of said second and said third bores operatively attached to said magazine and slidably mounted in its respective one of said second and third bores, said spring seats cooperating with their respective compression spring to urge said magazine to its extended fastener starting position.

11. The tool claimed in claim 1 wherein said guide block comprises a pair of parallel spaced walls joined by a top web, said walls define an open ended slot, said magazine being shiftable between said walls toward and away from said web between said fastener starting position substantially out from between said guide block walls and said fastener driven position substantially between said guide block walls, each of said guide block walls having a forward end, each of said guide block walls having a large bore spaced inwardly of said wall forward end and followed by two smaller diameter bores, corresponding bores of both walls lying opposite each other, all of the bores of each wall being parallel and extending perpendicularly to the longitudinal axis of their respective wall, each bore of said guide block having a slot by which it is connected to said open ended slot of said guide block, a guide and biasing system for said magazine, said guide and biasing system comprising a pair of guide rods affixed to the ends of a bridge member constituting a bridge and guide rod assembly, said guide rods being of a diameter to just nicely slide in said large diameter guide block bores, said bridge being accommodated by said slots of said large diameter bores, said guide and biasing system further comprises a pair of bridge members with rod-like spring seats affixed to their ends and each constituting a bridge and spring seat assembly, each of said spring seat and bridge assemblies having their spring seats slidably mounted in a pair of corresponding smaller diameter bores with said bridge accommodated by said slots of said small diameter bores, said bridges of said spring seat and bridge assemblies having clearance bores formed therein, said bridge of said bridge and guide rod assembly having corresponding threaded bores therein, said bridge of said bridge and guide rod assembly being affixed to a pair of braces extending perpendicularly of said bridge of said bridge and guide rod assembly, said braces having forward ends attached to said guide body and overlying the front portion of said magazine, said bridge and spring seat assemblies having a pair of machine screws passing through said clearance holes of their respective bridges and threadedly engaged in said threaded bores of said bridge of said bridge and guide rod assembly, tubular spacers mounted on said machine screws between said bridges, said spacers sized to allow slight shifting of said bridge and spring seat assemblies along said machine screws, said spring seats of said bridge and spring seat assemblies being slidably mounted in said smaller diameter bores and each being surmounted by a compression spring captively mounted in its respective smaller diameter bore, said bridge and guide rod assembly guiding and maintaining proper orientation of said magazine during shifting thereof, said bridge and spring seats and their respective compression springs biasing said magazine to its extended fastener starting position.

12. The tool claimed in claim 1 including a pair of guide rods operatively attached to said magazine, each of said guide rods being slidable within a first bore in each of said guide block walls to guide said movement of said magazine, said guide block walls each having second and third bores adjacent said first bore therein, a compression spring mounted in each of said second and said third bores, a rod-like spring seat for each of said second and said third bores operatively attached to said magazine and slidably mounted in its respective one of said second and third bores, said spring seats cooperating with their respective compression spring to urge said magazine to its extended fastener starting position.

13. The tool claimed in claim 1 including a first manual trigger-actuated switch, a second switch so positioned on said tool as to be actuated and unactuated by said magazine, a third switch mounted on said tool above said second switch and being actuated and unactuated by said magazine, when said magazine is pressed against the workpiece by the operator, said magazine will shift upwardly enough to change the state of said second switch, said second switch may undergo said state change before or after actuation of said trigger switch, when both said first trigger switch and said second switch have changed state said motor will be energized causing a fastener to be driven into and counter sunk in said workpiece, when said fastener has been fully driven, said magazine will change the state of said third switch to shut off said motor even if said trigger and said trigger switch have not been released by said operator, said sequence being repeatable when said magazine returns to its extended position.

14. The tool claimed in claim 13 wherein said third switch is shiftable to a position further spaced above said second switch whereby to increase the number of blows if said workpiece is made of hard material or to increase the depth of drive.

15. The tool claimed in claim 13 including a fourth switch mounted on said tool and actuable by said magazine, said third and fourth switches being selectable by said operator to adjust the number of blows or the depth of drive.

16. The tool claimed in claim 13 including a time delay circuit in association with said third switch actuable by said operator to increase the depth of drive and/or the number of blows.

17. The tool claimed in claim 13 wherein said third switch is mounted in association with said guide body and is actuable by a flag mounted in association with said driver whereby to assure that said fastener will be fully driven and countersunk regardless of the hardness of the workpiece.

* * * * *